United States Patent [19]

Skvaril

[11] Patent Number: 4,640,412

[45] Date of Patent: Feb. 3, 1987

[54] SELF-CONTAINING PACKAGE SYSTEM FOR STORAGE AND TRANSPORTATION OF PRE-FABRICATED PORTIONS OF A BUILDING STRUCTURE AND THE ASSEMBLY THEREOF

[76] Inventor: Joseph Skvaril, 4807 -143rd St., Edmonton, Alberta, Canada, T6H 4C9

[21] Appl. No.: 686,829

[22] Filed: Dec. 27, 1984

[51] Int. Cl.[4] ..... E04H 1/12

[52] U.S. Cl. ..... 206/321; 52/79.5; 52/143; 52/125.2

[58] Field of Search ..... 52/79.5, 143, 125.2, 52/650, 648; 206/321

[56] References Cited

U.S. PATENT DOCUMENTS

| | | | |
|---|---|---|---|
| 2,570,234 | 10/1951 | Harris | 206/321 |
| 2,950,078 | 8/1960 | Phillips | 108/53.1 |
| 2,998,132 | 8/1961 | Wilson | 206/321 |
| 3,284,966 | 11/1966 | Bolt | 52/125.2 |
| 3,683,571 | 8/1972 | Walz | 52/125.2 |
| 3,752,087 | 8/1973 | Finke | 108/53.1 |
| 3,756,167 | 9/1973 | Wilson | 108/53.1 |
| 3,895,588 | 7/1975 | Miller | 108/53.1 |
| 4,005,556 | 2/1977 | Tuomi | 52/650 |
| 4,283,890 | 8/1981 | Takeda | 52/143 |

*Primary Examiner*—Henry E. Raduazo
*Attorney, Agent, or Firm*—Stanley G. Ade

[57] ABSTRACT

A floor or ceiling unit is prefabricated in two halves which can be assembled together to form the unit or one of the halves can be turned upsidedown and nested underneath the other half thus forming a package with upper and lower panels. These panels can be secured together and reduce the overall width of the package to a dimension which is smaller than the maximum allowable width for transportation on world roads.

Also included are vertical support members and the pair of perimetrical beams which extend between the vertical support members and means on the beams and support members to receive and support the assembled floor or ceiling unit. The vertical support members and the perimetrical beams can be stored between the joists of the two halves when they are packaged for transportation and a plurality of such packages can be stacked one upon the other upon a truck or the like thus enabling an entire building to be transported readily and easily and within allowable size limits and which can be readily erected on site with the minimum of effort.

32 Claims, 6 Drawing Figures

SELF-CONTAINING PACKAGE SYSTEM FOR STORAGE AND TRANSPORTATION OF PRE-FABRICATED PORTIONS OF A BUILDING STRUCTURE AND THE ASSEMBLY THEREOF

BACKGROUND OF THE INVENTION

This invention relates to new and useful improvements in pre-fabricated structures and is an improvement on my corresponding Canadian Pat. No. 1,018,719.

The present structure allows pre-manufacturing or pre-fabrication of relatively large floor/roof structures and its transportation in a relatively small sized, self-containing package with useable space therein for storing other portions of the structure such as perimetrical beams, vertical supports and the like.

The structure may be erected readily and easily from the package and of course can be easily dismantled and transported again in the self-containing component package of minimum size because the floor/roof components may be connected with the others in the structure from the inside thereof while the portions of these components may be connected in a package for transportation, from outside of the package.

The small sized component package is readily transportable anywhere and in any climate because it is self-contained and the nesting construction of the two halves of each floor/roof component adds strength to the package. The structures are rapidly erected with relatively unskilled labour regardless of the size and volume required.

SUMMARY OF THE INVENTION

In the present system, a square or rectangular floor/-roof component of any size, with its shorter side being larger than the maximum load width transportable on highways, is split into two or more portions so that this side does not exceed the maximum load width permitted.

Each floor/roof component package includes at least two portions of the structure, one placed in nesting relationship with the other and both creating a self-closing surface on the upper and lower sides enclosed by their roof or floor decks or panels.

In accordance with the invention there is provided a floor/ceiling package for prefabricated structures comprising in combination a plurality of spaced and parallel transverse joists and a planar panel spanning one side of said joists and acting as a floor or ceiling surface, said package including two halves, means to detachably secure said halves together along a common junction line to form a floor or ceiling unit, said junction line extending parallel to said joists, each half having a joist at the common junction line for selectively securing said halves together, said halves being nestable one within the other to form said package when separated, one of said halves being reversed vertically through 180° relative to the other half and placed whereby said joists of one half are nested within said corresponding joists of the other half so that said planar panels form upper and lower enclosure surfaces of said package, and means to detachably secure said halves together to form said package.

In accordance with another aspect of the invention there is provided a self-containing package system for pre-fabricated structures which include at least two similar floor/ceiling units, at least four vertical support members and at least two perimetrical beam members, each said floor/ceiling units including a plurality of spaced and parallel transverse joists and a planar panel spanning one side of said joists and acting as a floor or ceiling surface, said package including two halves, means to detachably secure said halves together along a common junction line to form a floor or ceiling unit, said junction line extending parallel to said joists, each half having a joist at the common junction line for selectively securing said halves together, said halves being nestable one within the other to form said package when separated, one of said halves being reversed vertically through 180° relative to the other half and placed whereby said joists of one half are nested within said corresponding joists of the other half so that said planar panels form upper and lower enclosure surfaces of said package, and means to detachably secure said halves together to form said package.

It will also be appreciated that the packages can be stacked one upon the other and thus create a further self-containing unit by securing the bottom deck of each additional package to the top deck of the package below before enclosing the upper package by the upper portion of the floor/roof half.

As the sizes and shapes of the components of the package and the structure are identical, the erection methods are interrelated and similar.

Another aspect of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a desciption of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
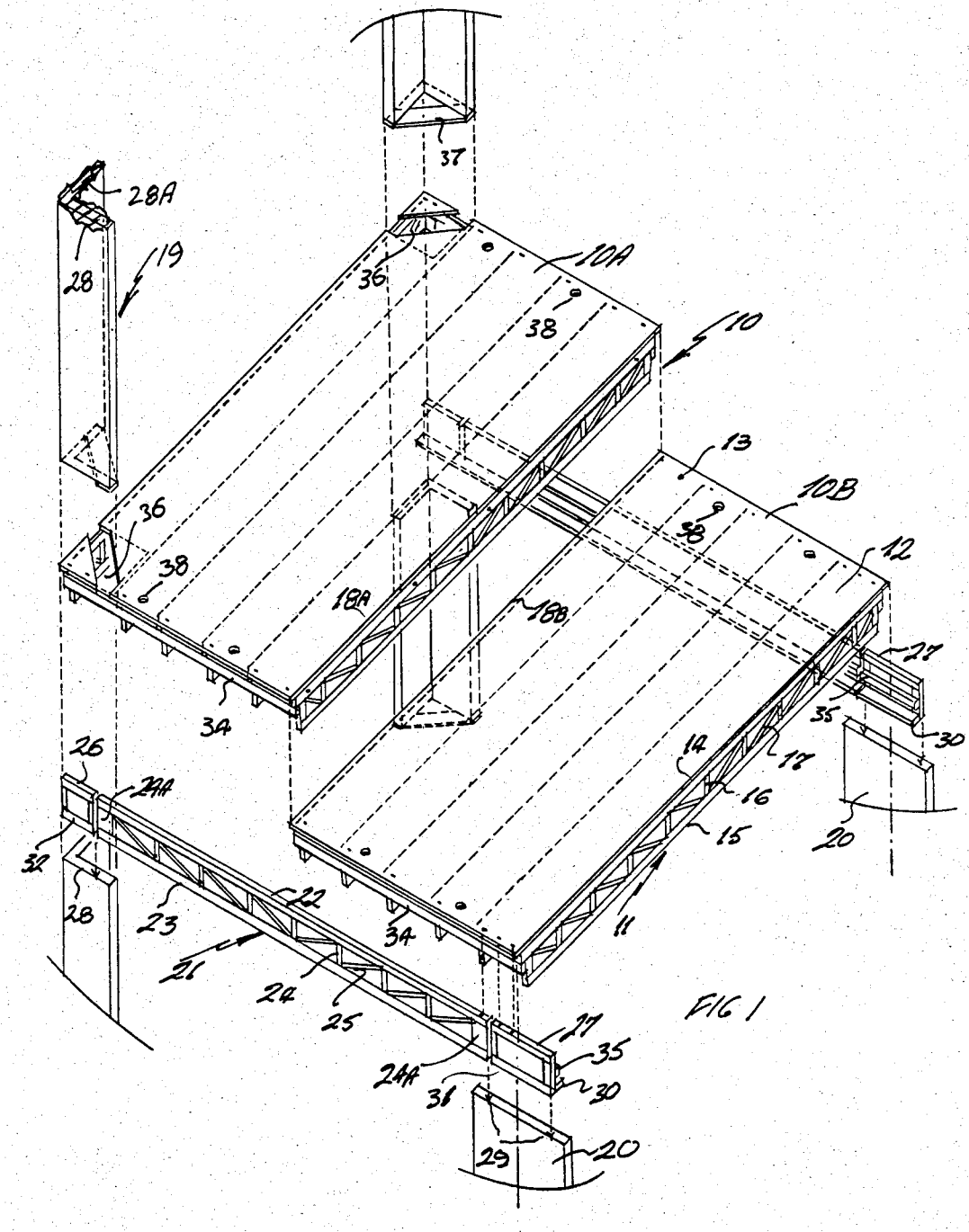
FIG. 1 is an axometric exploded view of the two halves of the floor/roof component and the supporting structure associated therewith.

Proceeding therefore to describe the invention in detail, reference should first be made to FIG. 1 which shows the completed package in its partially assembled form. It consists of a floor/ceiling component collectively designated 10 and consisting, in this embodiment, of two halves 10A and 10B. However it will be appreciated that, depending upon size and design parameters, the component 10 can consist of a plurality of parts but should contain at least two parts.

This component 10 comprises a plurality of spaced and parallel joists or trusses 11 surmounted by a floor or ceiling panel or deck 12 which is secured to the trusses by nails, screws or other conventional means and indicated by reference character 13.

In the present embodiment, trusses are shown but of course conventional joists can be used. The trusses incorporate the upper member 14, a lower member 15, vertical struts 16 and diagonal struts 17 all of which are substantially conventional.

It will also be noted that the two halves 10A and 10B, when assembled together in side by side relationship include a truss or joist immediately adjacent the inner edges 18A and 18B which facilitates the joining of the two halves together by means of screws or other fasteners (not illustrated).

Two types of vertical support members are shown, namely, L-shaped members 19 and straight or planar members 20. The L-shaped members 19 are specifically provided for corner supports and the planar members 20 for intermediate supports.

These L-shaped members which may be metal or wood, are of a height to space a pair of units 10 a sufficient distance apart so that one may act as a ceiling (not illustrated) and the other as a floor as illustrated in FIG. 1.

These are secured to a base (not illustrated) and extend upwardly and adjacent corner members 19 and intermediate members 20 receive a perimetrical beam member collectively designated 21 as will hereinafter be described. These perimetrical beam members include an upper horizontal member 22, a lower horizontal member 23, vertical struts 24 and diagonal struts 25 and are similar in construction to the trusses 11. However the end vertical members 24A are substantially wider than the intermediate members 24 for strength purposes. Perimetrical beam blocks 26 and 27 are provided at each end of the perimetrical beam members 21 to facilitate assembly to the vertical support members 19 and 20. The perimetrical beam block 26 rests on the flange 28 of the corner member which is parallel to the planar member 20 and is of a size that, when installed, the adjacent end of the perimetrical beam member 21 also rests on this flange and can be secured thereto and to the block 26, by means of nails or screws as will hereinafter be described. The same method of attachment occurs with beam block 27 and the adjacent end of the perimetrical beam upon the planar vertical support 20. In other words marks or indicia are provided on the upper edge of the member 20 as indicated by reference character 29 to facilitate the location of the block 27 thereon and leave equal space upon either side for the receipt of the adjacent end of the perimetrical beam 21.

An anchoring support strut 30 is secured to the lower horizontal member 23 of the perimetrical beam and the corresponding member 31 of the block 27 and 32 of the block 26. This extends inwardly and permits nails or screws 33 to be engaged diagonally through the member 30 and into the vertical supports 19 or 20 as shown in phantom in FIG. 3. Once again the block 26 may be secured to the adjacent end of the beam 21 by means of nails or screws as desired.

A pair of such perimetrical beams are provided as illustrated in FIG. 1 to receive the unit 10.

Each half of the units 10 includes a perimetrical beam member engaging strut 34 secured to the ends of the joists or trusses 11 perpendicular thereto and between the upper and lower members 14 and 15, it being understood that there is such a strut 34 on each end of both sections 10A and 10B.

Figure 2:
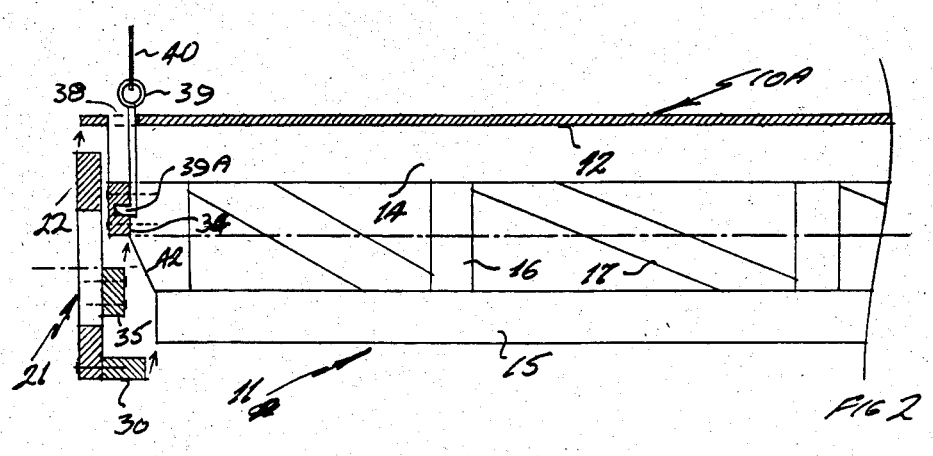
FIG. 2 is a partially exploded and partially cross-sectioned view of the floor/roof unit being engaged upon one of the perimetrical beams.
Figure 3:
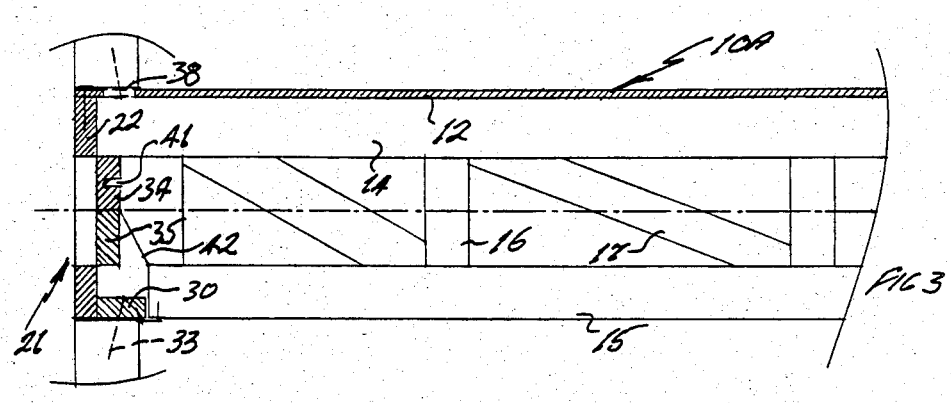
FIG. 3 is a view similar to FIG. 1 but showing the unit engaged with the perimetrical beam which in turn is supported upon one of the vertical components.

A unit engaging strut 35 is secured to the inner face of each of the perimetrical beam members 25 and intermediate the upper and lower members 22 and 23 thereof and parallel therewith so that when the unit 10 is lowered into place, the struts 34 engage upon the struts 35 as clearly shown in FIGS. 2 and 3 and these struts are positioned so that the upper surface of the deck 12 is substantially flush with the upper members 22. When in position, the outer truss members of the unit 10 complete the perimetrical beam support provided by the perimetrical beams 21 and securement may be adjacent the outer corners through diagonal apertures 36 and into the upper members 26 and 14 of the beam blocks and end trusses respectively.

If upper vertical support members are required, these may be engaged adjacent the outer corners of the unit and in this connection diagonal bars or struts 37 are secured to the flanges 28 and 28A of the corner or L-shaped vertical support members and these struts 37 engage within the diagonal apertures 36 formed in the outer corners of the unit half 1A and may be nailed or otherwise secured to the upper sides of the members 26 and 14. Prior to such erection, any wiring or plumbing can be accessed through these apertures and also through additional apertures 38 adjacent the joist ends of the halves 10A and 10B.

Reference to FIGS. 2 and 3 show the method of assembly and disassembly by the use of lifting hooks 39 attachable to ropes or tables 40 which in turn may be connected to a crane or winch (not illustrated).

The lower ends of these hook elements 39 are angulated as at 39A and engage downwardly through the apertures 38 adjacent the joist ends of the sections 10A and 10B. The hooked ends then engage within apertures 41 formed in the perimetrical beam engaging strips 34 and permit easy lifting of the individual sections.

When being lowered in position as shown in FIG. 2, the angulated or sloped ends 42 of the joists or trusses, act to guide the sections into position so that the strips 34 engage upon strips 35 whereupon securement may be undertaken via nails 33 as hereinbefore described and shown in FIG. 3.

As mentioned previously, the floor/ceiling unit 10 is formed in two or more portions and as an example, the two portions illustrated may each be 4800 mm by 3000 mm so that when they are secured together and installed as shown in FIGS. 1, 2 and 3, the overall size of the floor/ceiling unit 10 becomes 6000 mm by 3000 mm.

Either a dividing wall (not illustrated) may be mounted upon the planar vertical supports 20 or, further floor/ceiling panels 10 may be placed to the side of the existing panel or unit terminating of course in two L-shaped members 19 to complete the room unit. Also end walls, doors and windows may be installed in walls attached to the vertical support members all of which is clearly disclosed in my previous U.S. Pat. No. 4,441,286.

However perhaps the most important aspect of the invention is the packaging for transportation or storage of the entire assembly with the divided floor/ceiling unit permitting a package to be provided which is within the limits for road transport. For example with the figures given above, the overall width of the package would be approximately 3000 mm (9¾ feet) with a length of 4800 mm (approximately 15¾ feet).

Figure 4:
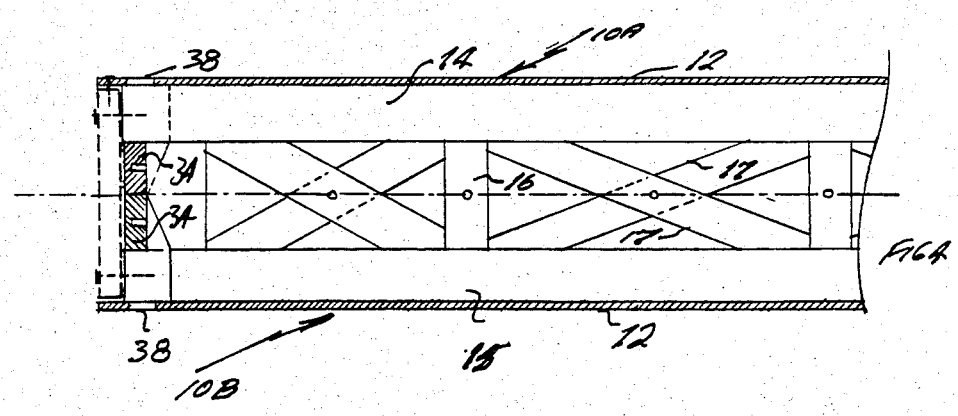
FIG. 4 is a partially cross-sectional view showing the two halves of the unit in nested relationship for transportation and/or storage.
Figure 5:
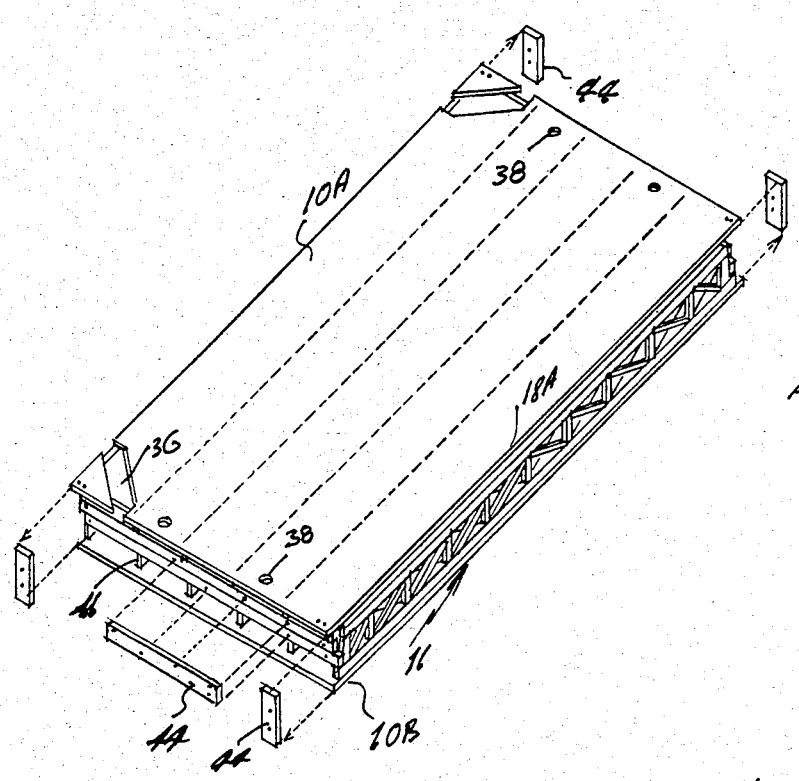
FIG. 5 is an axometric view of the self-contained package with the holding plates shown spaced therefrom for clarity.
Figure 6:
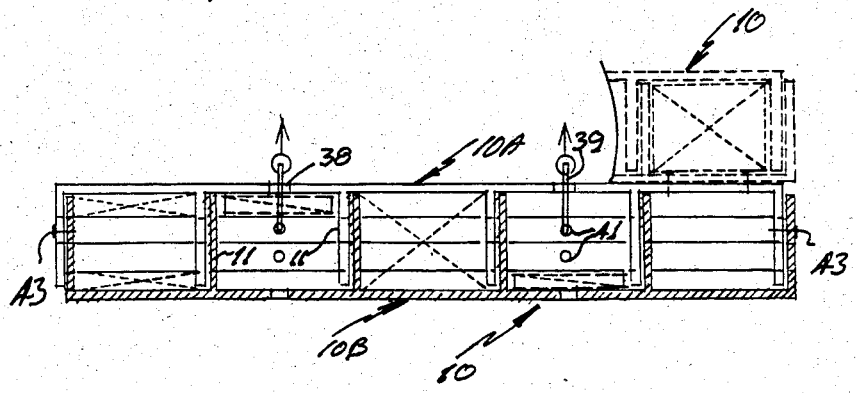
FIG. 6 is a longitudinal section of FIG. 5 cross-sectioned in part for clarity.

FIGS. 4, 5 and 6 show details of the packaging concept. Each half or portion of the unit 10 can be nested one within the other by reversing one of the portions through 180° in vertical plane relative to the other portion so that the joists of this rotated portion face uppermost thus enabling the joists of the first portion to be lowered into nesting engagement with the lower portion as clearly shown in FIGS. 4, 5 and 6 with the beam engaging strips 34 resting upon one another as clearly shown in FIG. 4 and the joists or trusses being in side by side relationship as clearly shown in FIG. 6.

Screws or other fastening means 43 may be engaged through the vertical or diagonal members of the joists thus holding the sections together and the remaining structure such as the vertical supports 19 and 20 may be stored within the cavities defined by the joists and the upper and lower decks or panels 12.

The lifting hooks 39 can still be engaged through apertures 9 and into the apertures 39A so that the entire package can be lifted from one location to another and to further secure the two portions together, blocks or strips 44, acting as connecting plates, may span the ends of the joists and may be secured thereto by nails or screws as clearly shown in FIG. 5.

Once the first package is located, further packages illustrated in phantom by reference character 45 may be stacked on top of the lower most package so that an entire structure may be stacked and secured one to the other via nails or screws 46 engaged through the lower most deck of one package and into the upper most deck of the next lower most package.

It will be noted that the overall width of the completed package is designed to be less than the maximum allowable width permissible upon highways and that a relatively large number of packages may be stacked one upon the other for transportation by truck or train.

When erecting the structure, the following are the steps involved.

Step 1: Once the package is opened, the beams stored in the bottom core are placed on support walls or columns depending upon design parameters. If the latter, these can also be stored in the package and are erected first. Each of the beams 21 is an integral part of the floor/roof component as a hole, bearing securely at one end, either both of the halves 10A and 10B of the unit 10 or all of the portions if more than two are involved. If the span between the support walls 20 and columns or L-shaped vertical members 19 is shorter than the length of the bearing members or beams 21 of the floor/roof components, the beam may be stored in the hollow core of the package in one piece. While no span should be longer than the distance between the vertical supports, the module may be substantially longer and the difference between the two may be projected in the lengths of the support walls with the continuity of the perimetrical beam being ensured by additional beam blocks similar to those indicated by reference characters 26 and 27. These can also be stored in the hollow space in the package.

Step 2: After the two halves or plurality of portions of the floor/roof component are positioned in the structure as illustrated in FIGS. 2 and 3, the perimetrical beam members 21 not only carries the full load but also closes that portion of either floor or roof structure. All connecting points such as screws from the upper deck of the floor/roof component to the top of the perimetrical beam member or screws from the bottom beam block to the top of the either straight or L-shaped vertical wall members are only accessible from the inside space limited in vertical direction by the size of the floor/roof component. The openings 36 in the deck at the corners of the end portion of the floor/roof component receive the brace for a corner wall for another story to insure that the prefabricated L-shaped vertical member or wall is positioned in all three directions automatically with no measuring or adjusting being necessary. The shaped of the opening 36 is identical to the shape of the brace 37 at the bottom of the next vertical member and the thickness of the deck of the floor/roof components is the same as the thickness of the brace which can if desired, be the portion of the deck that is removed to form aperture 36. This interlocking system also strengthens the structure as a whole while the corner wall lower side of the upper floor can be secured to the top deck of the floor/roof component below by screws or the like once again applied from the inside of the floor or roof component below the top deck.

Step 3: While the vertical walls 20 and columns 19 which support the floor/roof components, may bear load from either one or two structural modules, the perimetrical beam members 21 of one floor/roof component is not statically connected with the beam of the other. The full size floor or roof components can thus be assembled on the ground and the entire floor or roof may be lifted and positioned on the supports as one unit.

It will therefore be seen that the present system provides an easy method of construction of floors or roofs because a larger and stronger structure may be built from lighter, but very rigid, pre-fabricated components which are easy to transport and erect. By maintaining continuity of the pre-fabrication between adjacent floors as described, electrical wiring and plumbing may be pre-build in the structural components to a greater degree then is possible in conventional pre-fabricated structures with traditional built floors or roofs.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A floor/ceiling package for prefabricated structures, said package including two halves, each half including a plurality of spaced and parallel transverse joists, each including ends and a planar panel spanning one side of said joists and acting as a floor or ceiling surface, means to detachably secure said halves together along a common junction line to form a floor or ceiling unit, said unit including corners, said junction line extending parallel to said joists, each half having a joist at the common junction line for selectively securing said halves together, said halves being nestable one within the other to form said package when separated, one of said halves being reversed vertically through 180° relative to the other half and placed whereby said joists of one half are nested within said corresponding joists of the other half so that said planar panels form upper and lower enclosure surfaces of said package, means to detachably secure said halves together to form said package and a perimetrical beam member engaging strut secured across the ends of all of said joists perpendicular to said joists and situated intermediate the upper and lower sides of said joists.

2. The package according to claim 1 in which said joists are in the form of trusses.

3. The package according to claim 1 which includes lifting hook access apertures in said panel and lifting hook engaging apertures below said panel.

4. The package according to claim 2 which includes lifting hook access apertures in said panel and lifting hook engaging apertures below said panel.

5. The package according to claim 1 in which said means to detachably secure said halves together as a package includes a plurality of connecting plates detachably secured to the ends of said joists of said halves at each end of said package.

6. The package according to claim 1 which includes vertical support members for each of said corners of said floor or ceiling unit, at least two of said corners being L-shaped in cross section and constituting L-shaped support members, a perimetrical beam member extending between one of said L-shaped members and another of said support members, a further perimetrical beam member extending between the other of said L-shaped members and the other of said support members and in spaced and parallel relationship with said first beam member, means to detachably secure said beam members to said support members, said unit being engageable upon the said perimetrical beam members, means on said perimetrical beam members to support said unit and means to detachably secure said unit to said perimetrical beam members.

7. The package according to claim 2 which includes vertical support members for each of said corners of said floor or ceiling unit, at least two of said corners being L-shaped in cross section and constituting L-shaped support members, a perimetrical beam member extending between one of said L-shaped members and another of said support members, a further perimetrical beam member extending between the other of said L-shaped members and the other of said support members and in spaced and parallel relationship with said first beam member, means to detachably secure said beam members to said support members, said unit being engageable upon the said perimetrical beam members, means on said perimetrical beam members to support said unit and means to detachably secure said unit to said perimetrical beam members.

8. The package according to claim 6 which includes beam connecting blocks at each end of each of said perimetrical beam members detachably securable to the upper ends of said vertical support members and to the adjacent ends of said perimetrical beam members, both the ends of said perimetrical beam members and said beam connecting blocks engaging upon said vertical support members when erected.

9. The package according to claim 6 in which said means on said perimetrical beam member to support said unit includes a unit engaging member secured to the inner side of said of said perimetrical beam member and extending longitudinally therealong intermediate the upper and lower sides of said beam member, said units engaging said unit engaging member.

10. The package according to claim 7 in which said means on said perimetrical beam member to support said unit includes a unit engaging member secured to the inner side of each of said perimetrical beam member and extending longitudinally therealong intermediate the upper and lower sides of said beam member, said units engaging said unit engaging member and a further anchor member secured to the inner side of each of said perimetrical beam members along the lower side thereof for securing said beam member to said vertical support members.

11. The package according to claim 8 in which said means on said perimetrical beam member to support said unit includes a unit engaging member secured to the inner side of each of said perimetrical beam member and extending longitudinally therealong intermediate the upper and lower sides of said beam member, said units engaging said unit engaging member.

12. The package according to claim 6 which includes means adjacent the corners of said units which are engable upon the said L-shaped vertical support members, for receiving and detachably securing the lower ends of a next adjacent vertical support member.

13. The package according to claim 12 in which said last mentioned means includes a diagonal opening formed in said panel and a diagonal member spanning the lower end of said next adjacent vertical member engagable within said diagonal opening, to locate and secure said next adjacent vertical member relative to said lower adjacent vertical member and means to detachably secure said next adjacent vertical member to said unit.

14. The package according to claim 7 which includes beam connecting blocks at each end of each of said perimetrical beam members detachably securable to the upper ends of said vertical support members and to the adjacent ends of said perimetrical beam members, both the ends of said perimetrical beam members and said beam connecting blocks engaging upon said vertical support members when erected.

15. The package according to claim 14 in which said means on said perimetrical beam member to support said unit includes a unit engaging member secured to the inner side of each of said perimetrical beam member and extending longitudinally therealong intermediate the upper and lower sides of said beam member, said units engaging said unit engaging member.

16. The package according to claim 15 which includes means adjacent the corners of said units which are engagable upon the said L-shaped vertical support members, for receiving and detachably securing the lower ends of a next adjacent vertical support member.

17. The package according to claim 16 in which said last mentioned means includes a diagonal opening formed in said panel and a diagonal member spanning the lower end of said next adjacent vertical member engagable within said diagonal opening, to locate and secure said next adjacent vertical member relative to said lower adjacent vertical member and means to detachably secure said next adjacent vertical member to said unit.

18. The device according to claim 17 in which said means on said perimetrical beam member to support said unit includes a unit engaging member secured to the inner side of each of said perimetrical beam member and extending longitudinally therealong intermediate the upper and lower sides of said beam member, said units engaging said unit engaging member, the said perimetrical beam engaging member of said unit engaging member of said perimetrical beam, and a further anchor member secured to the inner side of each of said perimetrical beam member along the lower side thereof for securing said beam member to said vertical support members.

19. A self-containing package system for prefabricated structures constituting a completed building structure when assembled and a package for storage and/or transportation, when disassembled and including two similar floor/ceiling halves, at least four vertical support members and at least two perimetrical beam members, each said floor/ceiling halves including a plurality of spaced and parallel transverse joists and a planar panel spanning one side of said joists and acting as a floor or ceiling surface, said package including two said halves, means to detachably secure said halves together along a common junction line to form a complete floor or ceiling unit when assembled, said junction line extending parallel to said joists, each half having a joist at the common junction line for selectively securing said halves together, and when disassembled, said halves being nestable one within the other to form said package when separated, one of said halves being reversed vertically through 180° relative to the other half and placed whereby said joists of one half are nested alongside said corresponding joists of the other half so that said planar panels form upper and lower enclosure surfaces of said package, means to detachably secure said halves together when nested one within the other, to form said package and a perimetrical beam member engaging strut secured across the ends of all of said joists perpendicular to said joists and situated intermediate the upper and lower sides of said joists.

20. The device according to claim 19 in which said joists are in the form of trusses.

21. The device according to claim 19 which includes lifting hook access apertures in said panel and lifting hook engaging apertures below said panel.

22. The device according to claim 20 which includes lifting hook access apertures in said panel and lifting hook engaging apertures below said panel.

23. The device according to claim 19 in which said means to detachably secured said halves together as a package includes a plurality of connecting plates detachably secured to the ends of said joists of said halves at each end of said package.

24. The device according to claim 20 which includes vertical support members for each of said corners of said floor or ceiling unit, at least two of said corners being L-shaped in cross section and constituting L-shaped support members, a first perimetrical beam member extending between one of said L-shaped members and another of said support members, a further perimetrical beam member extending between the other of said L-shaped members and the other of said support members and in spaced and parallel relationship with said first beam member, means to detachably secure said beam members to said support members, said unit being engagable upon the said perimetrical beam members, means on said perimetrical beam members to support said unit and means to detachably secure said unit to said perimetrical beam members.

25. The device according to claim 21 which includes vertical support members for each of said corners of said floor or ceiling unit, at least two of said corners being L-shaped in cross section and constituting L-shaped support members, a first perimetrical beam member extending between one of said L-shaped members and another of said support members, a further perimetrical beam member extending between the other of said L-shaped members and the other of said support members and in spaced and parallel relationship with said first beam member, means to detachably secure said beam members to said support members, said unit being engagable upon the said perimetrical beam members, means on said perimetrical beam members to support said unit and means to detachably secure said unit to said perimetrical beam members.

26. The device according to claim 24 which includes beam connecting blocks at each end of each of said perimetrical beam members detachably securable to the upper ends of said vertical support members and to the adjacent ends of said perimetrical beam members, both the ends of said perimetrical beam members and said beam connecting blocks engaging upon said vertical support members when erected.

27. The device according to claim 25 which includes beam connecting blocks at each end of each of said perimetrical beam members detachably securable to the upper ends of said vertical support members and to the adjacent ends of said perimetrical beam members, both the ends of said perimetrical beam members and said beam connecting blocks engaging upon said vertical support members when erected.

28. The device according to claim 27 in which said means on said perimetrical beam member to support said unit includes a unit engaging member secured to the inner side of each of said perimetrical beam member and extending longitudinally therealong intermediate the upper and lower sides of said beam member, said units engaging said unit engaging member, the said perimetrical beam engaging member of said unit engaging member of said perimetrical beam, and a further anchor member secured to the inner side of each of said perimetrical beam member along the lower side thereof for securing said beam member to said vertical support members.

29. The device according to claim 24 in which said means on said perimetrical beam member to support said unit includes a unit engaging member secured to the inner side of each of said perimetrical beam member and extending longitudinally therealong intermediate the upper and lower sides of said beam member, said units engaging said unit engaging member, the said perimetrical beam engaging member of said unit engaging said unit engaging member of said perimetrical beam, and a further anchor member secured to the inner side of each of said perimetrical beam member along the lower side thereof for securing said beam member to said vertical support members.

30. The device according to claim 26 in which said means on said perimetrical beam member to support said unit includes a unit engaging member secured to the inner side of each of said perimetrical beam member and extending longitudinally therealong intermediate the upper and lower sides of said beam member, said unit engaging said unit engaging member and a further anchor member secured to the inner side of each of said perimetrical beam member along the lower side thereof for securing said beam member to said vertical support members.

31. The device according to claim 19 which includes means adjacent the corners of said units which are engable upon the said L-shaped vertical support members, for receiving and detachably securing the lower ends of a next adjacent vertical support member.

32. The device according to claim 31 in which said last mentioned means includes a diagonal opening formed in said panel and a diagonal member spanning the lower end of said next adjacent vertical member engagable within said diagonal opening, to locate and secure said next adjacent vertical member relative to said lower adjacent vertical member and means to detachably secure said next adjacent vertical member to said unit.

* * * * *